US009129519B2

(12) United States Patent
Aoude et al.

(10) Patent No.: US 9,129,519 B2
(45) Date of Patent: Sep. 8, 2015

(54) SYSTEM AND METHOD FOR PROVIDING DRIVER BEHAVIOR CLASSIFICATION AT INTERSECTIONS AND VALIDATION ON LARGE NATURALISTIC DATA SETS

(71) Applicant: Massachusetts Institute of Technology, Cambridge, MA (US)

(72) Inventors: Georges Aoude, Dallas, TX (US); Vishnu Rajeswar Desaraju, Cambridge, MA (US); Jonathan P. How, Arlington, MA (US); Thomas Edward Pilutti, Ann Arbor, MI (US)

(73) Assignee: Massachussetts Institute of Technology, Cambridge, MA (US)

( * ) Notice: Subject to any disclaimer, the term of this patent is extended or adjusted under 35 U.S.C. 154(b) by 0 days.

(21) Appl. No.: 13/954,954

(22) Filed: Jul. 30, 2013

(65) Prior Publication Data

US 2014/0032089 A1 Jan. 30, 2014

Related U.S. Application Data

(60) Provisional application No. 61/677,033, filed on Jul. 30, 2012.

(51) Int. Cl.

| | |
|---|---|
| ***G08G 1/00*** | (2006.01) |
| ***G08G 1/0962*** | (2006.01) |
| ***G08G 1/16*** | (2006.01) |

(52) U.S. Cl.

CPC ..... *G08G 1/00* (2013.01); *G08G 1/0962* (2013.01); *G08G 1/162* (2013.01); *G08G 1/166* (2013.01)

(58) Field of Classification Search

CPC ..... G08G 1/162; G08G 1/166; G08G 1/0962

USPC ..... 701/23, 70, 117, 301; 340/438; 348/149

See application file for complete search history.

(56) References Cited

U.S. PATENT DOCUMENTS 6,647,361 B1 * 11/2003 Laird et al. ..... 703/8
7,317,406 B2 1/2008 Wolterman (Continued)

OTHER PUBLICATIONS

Sargur Srihari, Machine Learning: Generative and Discriminative Models, Dec. 2007, Cedar University at Buffalo, Department of Computer Science and Engineering, retreived from http://www.cedar.buffalo.edu/~srihari/CSE574/index.html on Oct. 29, 2014.*

(Continued)

*Primary Examiner* — Fadey Jabr
*Assistant Examiner* — Thomas Ingram
(74) *Attorney, Agent, or Firm* — Peter A. Nieves; Sheehan Phinney Bass + Green PA

(57) ABSTRACT

A system and method for predicting whether a vehicle will come to a stop at an intersection is provided. Generally, the system contains a memory; and a processor configured by the memory to perform the steps of: generating a prediction of whether the vehicle will or will not stop at the intersection before a first time based on vehicle data measured during a first time window; and at a second time, the second time being before the first time and approximately equal to a time at which the time window ends, providing an indication that the vehicle will not stop at the intersection before the first time based upon the prediction, wherein generating the prediction comprises using a classification model, the classification model configured to indicate whether the vehicle will or will not stop at the intersection before the first time based on a plurality of input parameters, and wherein the plurality of input parameters are selected from the group consisting of speed, acceleration, and distance to the intersection.

17 Claims, 10 Drawing Sheets

(56) References Cited

U.S. PATENT DOCUMENTS

| | | | | |
|---|---|---|---|---|
| 2006/0252999 | A1* | 11/2006 | Devaul et al. | 600/300 |
| 2008/0266072 | A1* | 10/2008 | Suzuki | 340/438 |
| 2009/0040054 | A1* | 2/2009 | Wang et al. | 340/576 |
| 2010/0004839 | A1* | 1/2010 | Yokoyama et al. | 701/70 |
| 2010/0076621 | A1* | 3/2010 | Kubotani et al. | 701/1 |
| 2011/0313609 | A1* | 12/2011 | Endo et al. | 701/23 |
| 2012/0139754 | A1* | 6/2012 | Ginsberg et al. | 340/905 |

OTHER PUBLICATIONS

Georges S. Aoude, Brandon D. Luders, Kenneth K. H. Lee, Daniel S. Levine, and Jonathan P. How; Threat Assessment Design for Driver Assistance System at Intersections; 2010 13th International IEEE Annual Conference on Intelligent Transportation Systems, Madeira Island, Portugal, Sep. 19-22, 2010.

Cortes, Corinna; Vapnik, Vladimir; Support Vector Networks; Machine Learning, 20, pp. 273-277 (1995).

National Highway Safety Traffic Safety Administration; Fatality Analysis Reporting System (FARS) Encyclopedia; taken from the Internet Oct. 28, 2013.

Yulan Liang, Michelle L. Reyes, and John D. Lee; Real-Time Detection of Driver Cognitive Distraction Using Support Vector Machines; IEEE Transactions on Inelligent Transportation Systems, vol. 8, No. 2, Jun. 2007; pp. 340-350.

Bénédicte Bougler, Delphine Cody, Christopher Nowakowski; California Intersection Decision Support: A Driver-Centered Approach to Left-Turn Collision Avoidance System Design; California Path Program Institute of Transportation Studies University of California, Berkeley; Jan. 2008.

Hiren M. Mandalia and Mandalia Dario D. Salvucci; Using Support Vector Machines for Lane-Change Detection; Proceedings of the Human Factors and Ergonomics Society Annual Meeting 2005 49: 1965.

Liping Zhang, Kun Zhou, Wei-bin Zhang; and James A. Misener; Prediction of Red Light Running Based on Statistics of Discrete Point Sensors; Transportation Research Record: Journal of the Transportation Research Board, No. 2128, Transportation Research Board of the National Academies, Washington, D.C., 2009, pp. 132-142.

James A. Bonneson, P.E., Ho Jun Son; Prediction of Expected Red-Light-Running Frequency at Urban Intersections; Submitted for Consideration of Presentation and Publication at: Transportation Research Board, 82st Annual Meeting Jan. 2003, Washington, D.C.

Kay Ch. Fuerstenberg, IBEO Automobile Sensor GmbH; A New European Approach for Intersection Safety—The EC-Project INTERSAFE Proceedings of the 8th International IEEE Conference on Intelligent Transportation Systems Vienna, Austria, Sep. 13-16, 2005.

Tulga Ersal, Helen J. A. Fuller, Omer Tsimhoni, Member, IEEE, Jeffrey L. Stein, and Hosam K. Fathy; Model-Based Analysis and Classification of Driver Distraction Under Secondary Tasks; IEEE Transactions on Intelligent Transportation Systems, vol. 11, No. 3, Sep. 2010, pp. 692-701.

Chih-Chung Chang and Chih-Jen Lin; LIBSVM: A Library for Support Vector Machines; http://www.csie.ntu.edu.tw/~cjlin/libsvm; Initial version: 2001.

Willie D. Jones; Keeping Cars; IEEE Spectrum, Sep. 2001.

Dario D. Salvucci; Inferring Driver Intent: A Case Study in Lane-Change Detection; Proceedings of the Human Factors and Ergonomics Society Annual Meeting 2004 48:p. 2228.

Oliver, Nuria; Pentland, Alex; Graphical Models for Driver Behavior Recognition in a SmartCar; Proceedings of the IEEE Intelligent Vehicles Symposium 2000, Dearborn (MI), USA Oct. 3-5, 2000.

Tim J. Gates, David A. Noyce, and Luis Laracuente; Analysis of Dilemma Zone Driver Behavior at Signalized Intersections; Resubmitted to TRB for Annual Meeting CD-ROM, Nov. 15, 2006.

Chan, Ching-Yao; Bouglar, Benedicte, Evaluation of Cooperative Roadside and Vehicle-Based Data Collection for Assessing Intersection Conflicts; 2005 IEEE; pp. 165-170.

A.R.A. van der Horst; A Time-Based Analysis of Road User Behaviour in Normal and Critical Encounters; Delft, Apr. 1990.

Holger Berndt, Stefan Wender, and Klaus Dietmayer; Driver Braking Behavior during Intersection Approaches and Implications for Warning Strategies for Driver Assistant Systems; Proceedings of the 2007 IEEE Intelligent Vehicles Symposium Instanbul, Turkey, Jun. 13-15, 2007.

Zachary R. Doerzaph; Development of a Threat Assessment Algorithm for Intersection Collision Avoidance Systems; Dissertation submitted to the Faculty of the Virginia Polytechnic Institute and State University; Nov. 27, 2007 Blacksburg, Virginia.

Michael Maile; Luca Delgrossi; Cooperative Intersection Collision Avoidance System for Violations (CICAS-V) for Avoidance of Violation-Based Intersection Crashes; Mercedes-Benz Research & Development North America, Inc. USA Paper No. 09-0118.

Zachary R. Doerzaph; Vicki L. Neale; Raymond J. Kiefer; Cooperative Intersection Collision Avoidance for Violations (CICAS-V) Threat Assessment Algorithm Development and Evaluation Method; Paper presented at the 89th Transportation Research Board Annual Meeting. Submitted: Nov. 13, 2009.

Georges S. Aoude, Vishnu R. Desaraju, Lauren H. Stephens, and Jonathan P. How; Behavior Classification Algorithms at Intersections and Validation using Naturalistic Data; 2011 IEEE Intelligent Vehicles Symposium (IV) Baden-Baden, Germany, Jun. 5-9, 2011.

Hesham Rakha, Member, IEEE, Ihab El-Shawarby, and José Reynaldo Setti; Characterizing Driver Behavior on Signalized Intersection Approaches at the Onset of a Yellow-Phase Trigger; IEEE Transactions on Intelligent Transportation Systems, vol. 8, No. 4, Dec. 2007.

Georges S. Aoude and Jonathan P. How; Using Support Vector Machines and Bayesian Filtering for Classifying Agent Intentions at Road Intersections; Technical Report ACL09-02 Aerospace Controls Laboratory Department of Aeronautics and Astronautics Massachusetts Institute of Technology; Sep. 15, 2009.

Lawrence R. Rabiner; A Tutorial on Hidden Markov Models and Selected Applications in Speech Recognition; Proceedings of the IEEE, vol. 77, No. 2, Feb. 1989; pp. 257-286.

Lucas Malta, Chiyomi Miyajima and Kazuya Takeda; A Study of Driver Behavior Under Potential Threats in Vehicle Traffic; IEEE Transactions on Intelligent Transportation Systems, vol. 10, No. 2, Jun. 2009; pp. 201-210.

Doug Cutting, Julian Kupiec, Jan Pedersen and Penelope Sibun; A Practical Part-of-Speech Tagger; Proceedings of the Third Conference on Applied Natural Language Processing, Trento, Italy. Association for Computational Linguistics, pp. 133-140, 1992.

John Leonard, David Barrett, Troy Jones, Matthew Antone, Robert Galejs, et al; A Perception-Driven Autonomous Urban Vehicle; Journal of Field Robotics 25(10), 727-774 (2008).

Yilu Zhang, William C. Lin, and Yuen-Kwok Steve Chin; A Pattern-Recognition Approach for Driving Skill Characterization; IEEE Transactions on Intelligent Transportation Systems, vol. 11, No. 4, Dec. 2010, pp. 905-916.

Shane B. McLaughlin, Jonathan M. Hankey, Thomas A. Dingus; A method for evaluating collision avoidance systems using naturalistic driving data; Accident Analysis and Prevention 40 (2008) 8-16.

Jeff A. Bilmes; A Gentle Tutorial of the EM Algorithm and its Application to Parameter Estimation for Gaussian Mixture and Hidden Markov Models; International Computer Science Institute, Apr. 1998.

Noor Elmitinya, Xuedong Yan, Essam Radwan, Chris Russo, Dina Nashar; Classification analysis of driver's stop/go decision and red-light running violation; Accident Analysis and Prevention 42 (2010) 101-111.

Raymond J. Kiefer; Jeremy Salinger; John J. Ference; Status of NHTSA's Rear-End Crash Prevention Research Program; Paper No. 05-0282; 2005.

Google/Official Blog; What We're Driving At; posted Saturday Oct. 9, 2010; Posted by Sebastian Thrun, Distinguished Software Engineer, http://googleblog.blogspot.com/2010/10/what-were-driving-at.html.

(56) References Cited

OTHER PUBLICATIONS

Vicki L. Neale, et al; Intersection Decision Support: Evaluation of a Violation Warning System to Mitigate Straight Crossing Path Collisions; Standard Title Page—Report on Federally Funded Project; Apr. 2006.

Maile, M., et al.; Cooperative Intersection Collision Avoidance System Limited to Stop Sign and Traffic Signal Violations (CICAS-V); Task 11 Final Report Objective Tests; Crash Avoidance Metrics Partnership on behalf of the Vehicle Safety Communications 2 Consortium; United States Department of Transportation, Federal Highway Administration; Sep. 30, 2008.

SVM Application List, 2006 [Online], Available at: http://www.clopinet.com/isabelle/Projects/SVM. downloaded Nov. 21, 2013.

M. Dunham and K. Murphy, PMTK3—Probabilistic Modeling Toolkit for matlab/octave, ver 3. [online]. Available: http://code.google.com/p/pmtk3/; Oct. 2010; downloaded Nov. 21, 2013.

Offer Grembek, Kun Zhou, Wei-Bin Zhang; Red-Light-Running Collision Avoidance; California PATH Program Institute of Transportation Studies University of California, Berkeley; California PATH Research Report; Feb. 2009.

Liping Zhang, Kun Zhou, Wei-bin Zhang and James A. Misener; Empirical Observations of Red Light Running at Arterial Signalized Intersection; Institute of Transportation Studies University of California, Berkeley; PATH Technical Note 2008-1, A Report for Task Order 6210; Dec. 2008.

McCall, J.C. ; Lab. for Intelligent & Safe Automobiles, California Univ., San Diego, La Jolla, CA ; Trivedi, M.M.; Driver Behavior and Situation Aware Brake Assistance for Intelligent Vehicles; Proceedings of the IEEE (vol. 95 , Issue: 2 ).

* cited by examiner

SYSTEM AND METHOD FOR PROVIDING DRIVER BEHAVIOR CLASSIFICATION AT INTERSECTIONS AND VALIDATION ON LARGE NATURALISTIC DATA SETS

CROSS-REFERENCE TO RELATED APPLICATION

This application claims priority to U.S. Provisional Application entitled, "ALGORITHMS FOR DRIVER BEHAVIOR CLASSIFICATION AT INTERSECTIONS VALIDATED ON LARGE NATURALISTIC DATA SET," having Ser. No. 61/677,033, filed Jul. 30, 2012, which is entirely incorporated herein by reference.

STATEMENT REGARDING FEDERALLY SPONSORED RESEARCH OR DEVELOPMENT

This invention was made with government support under Contract No. N68335-09-C-0472 awarded by the U.S. Navy Naval Air Systems Command. The government has certain rights in the invention.

FIELD OF THE INVENTION

The present invention is generally related to sensing and computational technologies for increasing road safety, and more particularly is related to driver behavior classification and validation.

BACKGROUND OF THE INVENTION

The field of road safety and safe driving has witnessed rapid advances due to improvements in sensing and computation technologies. Active safety features such as antilock braking systems and adaptive cruise control have widely been deployed in automobiles to reduce road accidents. However, the U.S. Department of Transportation (DOT) still classifies road safety as "a serious and national public health issue." In 2008, road accidents in the U.S. caused 37,261 fatalities and about 2.35 million injuries. A particularly challenging driving task is negotiating traffic intersection safely. An estimated 45% of injury crashes and 22% of roadway fatalities in the U.S. are intersection related. A main contributing factor in these accidents is the inability of a driver to correctly assess and/or observe danger involved in such situations. These data suggest that driver assistance or warning systems may have an appropriate role in reducing the number of accidents, improving the safety and efficiency of human-driven ground transportation systems. Such systems typically augment the situational awareness of the driver and can also act as collision mitigation systems.

Research on intersection decision support systems has become quite active in both academia and the automotive industry. In the US, the federal DOT, in conjunction with the California, Minnesota, and Virginia DOTs, as well as several U.S. research universities, is sponsoring the Intersection Decision Support project and, more recently, the Cooperative Intersection Collision Avoidance Systems (CICAS) project. In Europe, the InterSafe project was created by the European Commission to increase safety at intersections. The partners in the InterSafe project include European vehicle manufacturers and research institutes. Both projects try to explore the requirements, tradeoffs, and technologies required to create an intersection collision avoidance system and demonstrate its applicability on selected dangerous scenarios.

Inferring driver intentions has been the subject of extensive research. For example, mind-tracking approaches have been introduced that extract the similarity of driver data to several virtual drivers created probabilistically using a cognitive model. In addition, other approaches have used graphical models and hidden Markov models (HMMs) to create and train models of different driver maneuvers using experimental driving data.

More specifically, the modeling of behavior at intersections has been studied using different statistical models. These studies have showed that the stopping at intersections behavior depends on several factors including driver profile (e.g., age and perception-reaction time) and yellow-onset kinematic and geometric parameters (e.g., vehicle speed and distance to intersection). One approach has developed red light running predictors based on estimating the time-to-arrival at intersections and the different stop-and-go maneuvers. It used speed measurements at two discrete point sensors, but the performance of this approach is limited by the complexity of the multidimensional optimization problem that must be solved.

A paper entitled "Intersection Decision Support: Evaluation of a Violation Warning System to Mitigate Striaght Crossing Path Crashes (report no. vtrc 06-cr10)," by V Neale. M. erez, Z. Doerzaph, S. Lee, S. Stone, and T. DingusVirginia Trans. Res. Council 2006, discusses the use of time-to-intersection (TTI) and its advantages over time-to-collision (TTC) for intersection safety systems. In addition, a paper entitled, "Cooperative intersection collision avoidance for violations: Threat assessment algorithm development and evaluation method," by Z. Doerzaph, V. Neale, and R. Kiefer, presented at the Transportation Research Board 89th Annual Meeting, Washington, D.C., 2010, Paper 10-2748, illustrates how different warning algorithms are developed for signalized and stop intersections based on a required deceleration parameter (RDP), TTI, and speed-distance regression (SDR) models. It is noted, however, that these authors only consider very simple relationships between the driving parameters, and do not combine flexibility to combine many parameters in the same model.

Thus, a heretofore unaddressed need exists in the industry to address the aforementioned deficiencies and inadequacies.

SUMMARY OF THE INVENTION

Embodiments of the present invention provide a system and method for predicting whether a vehicle will come to a stop at an intersection and classifying the vehicle accordingly. Briefly described, in architecture, one embodiment of the system, among others, can be implemented as follows. Generally, the system contains a memory; and a processor configured by the memory to perform the steps of: generating a prediction of whether the vehicle will or will not stop at the intersection before a first time based on vehicle data measured during a first time window; and at a second time, the second time being before the first time and approximately equal to a time at which the time window ends, providing an indication that the vehicle will not stop at the intersection before the first time based upon the prediction, wherein generating the prediction comprises using a classification model, the classification model configured to indicate whether the vehicle will or will not stop at the intersection before the first time based on a plurality of input parameters, and wherein the plurality of input parameters are selected from the group consisting of speed, acceleration, and distance to the intersection.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present system and method estimates driver behavior at signalized road intersections and validates the estimations on real traffic data. Functionality is introduced to classify drivers as compliant or violating. Two approaches are provided for classifying driver behavior at signalized road intersections. The first approach combines a support vector machine (SVM) classifier with Bayesian filtering (BF) to discriminate between compliant drivers and violators based on vehicle speed, acceleration, and distance to intersection. The second approach, which is a hidden Markov model (HMM)-based classifier, uses an expectation-maximization (EM) algorithm to develop two distinct HMMs for compliant and violating behaviors.

The present system and method infers driver behavior at signalized road intersections and validates them using naturalistic data. As is exemplified in further detail herein, the system and method may be provided in vehicle-based systems, infrastructure-based systems, or other systems.

Classes of algorithms as described herein are provided based on distinct branches of classification in machine learning to model driver behaviors at signalized intersections. The present system and method validates these algorithms on a large naturalistic data set.

Figure 1:
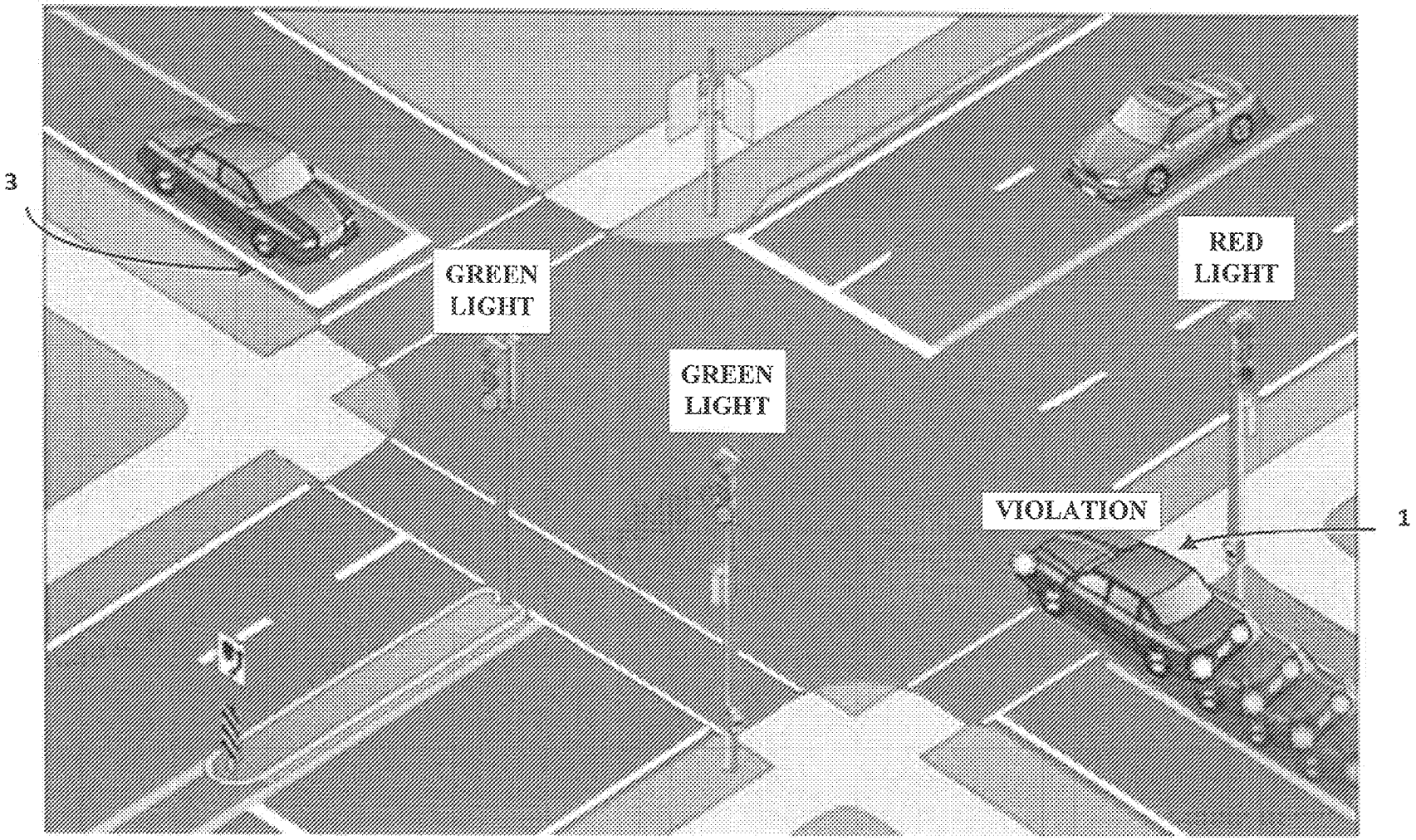
FIG. 1 is a schematic diagram illustrating an intersection controlled by a traffic signal, in which the present classifier may be implemented.

The present invention considers an intersection controlled by a traffic signal, as shown by the schematic diagram of FIG. 1. As a vehicle approaches the intersection, the objective is to predict from a set of observations whether a driver of the vehicle will stop safely if the signal indicates to do so. Drivers who do not stop before the stop bar are considered to be violators 1, whereas those who do stop are considered to be compliant 3. Naturally, drivers behave differently, and the variation in the resulting observations must be taken into account in a human classification process.

The ability to classify human drivers lays the foundation for more advanced driver assistance systems, which are enabled by the present system and method. In particular, these systems are able to warn drivers of their own potential violations as well as detect other potential violators approaching the intersection. Integrating the classifier of the present invention into a driver assistance system imposes performance constraints that balance violator detection accuracy with driver annoyance.

It should be noted that while the present disclosure describes the classification of human drivers, one having ordinary skill in the art would appreciate that classification may be provided for vehicles that do not have human drivers. The following provides for analysis and handling of both situations.

Functionality of the classifier 10 of the present invention can be implemented in software, firmware, hardware, or a combination thereof. In a first exemplary embodiment, functionality of the classifier 10 may be implemented in software, as an executable program, and is executed by a special or general-purpose digital computer, such as a personal computer, a personal data assistant, a computing module located on a vehicle, such as, but not limited to, for providing a driver assistance system, a smart phone, a workstation, a minicomputer, or a mainframe computer. The first exemplary embodiment of a classifier 10 is shown in FIG. 2.

Figure 2:
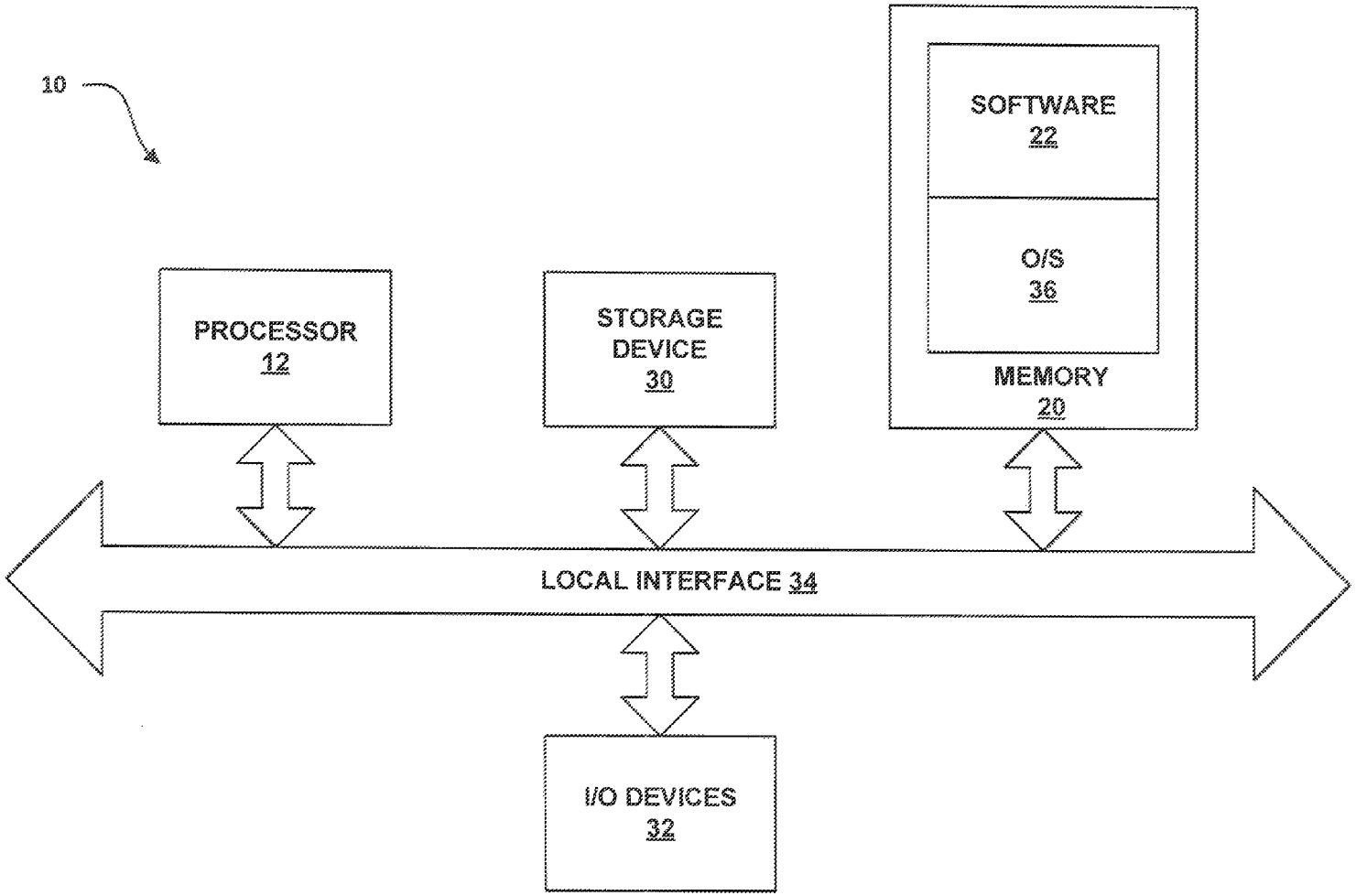
FIG. 2 is a schematic diagram illustrating a classifier in accordance with a first exemplary embodiment of the invention.

Generally, in terms of hardware architecture, as shown in FIG. 2, the classifier 10 includes a processor 12, memory 20, storage device 30, and one or more input and/or output (I/O) devices 32 (or peripherals) that are communicatively coupled via a local interface 34. The local interface 34 can be, for example but not limited to, one or more buses or other wired or wireless connections, as is known in the art. The local interface 34 may have additional elements, which are omitted for simplicity, such as controllers, buffers (caches), drivers, repeaters, and receivers, to enable communications. Further, the local interface 34 may include address, control, and/or data connections to enable appropriate communications among the aforementioned components.

The processor 12 is a hardware device for executing software, particularly that stored in the memory 20. The processor 12 can be any custom made or commercially available processor, a central processing unit (CPU), an auxiliary processor among several processors associated with the classifier 10, a semiconductor based microprocessor (in the form of a microchip or chip set), a macroprocessor, or generally any device for executing software instructions.

The memory 20 can include any one or combination of volatile memory elements (e.g., random access memory (RAM, such as DRAM, SRAM, SDRAM, etc.)) and nonvolatile memory elements (e.g., ROM, hard drive, tape, CDROM, etc.). Moreover, the memory 20 may incorporate electronic, magnetic, optical, and/or other types of storage media. Note that the memory 20 can have a distributed architecture, where various components are situated remote from one another, but can be accessed by the processor 12.

The software 22 in the memory 20 may include one or more separate programs, each of which contains an ordered listing of executable instructions for implementing logical functions of the classifier 10, including, but not limited to, the algorithms described hereinbelow. In the example of FIG. 2, the software 22 in the memory 20 defines the classifier 10 functionality in accordance with the present invention. In addition, although not required, it is possible for the memory 20 to contain an operating system (O/S) 36. The operating system 36 essentially controls the execution of computer programs and provides scheduling, input-output control, file and data management, memory management, and communication control and related services.

Functionality of the classifier 10 may be provided by a source program, executable program (object code), script, or any other entity containing a set of instructions to be performed. When a source program, then the program needs to be translated via a compiler, assembler, interpreter, or the like, which may or may not be included within the memory 20, so as to operate properly in connection with the O/S 36. Furthermore, the classifier 10 can be written as (a) an object oriented programming language, which has classes of data and methods, or (b) a procedure programming language, which has routines, subroutines, and/or functions.

The I/O devices 32 may include input devices, for example but not limited to, a touch screen, a keyboard, mouse, scanner, microphone, or other input device. Furthermore, the I/O devices 32 may also include output devices, for example but not limited to, a display, loudspeaker, or other output devices. The I/O devices 32 may further include devices that communicate via both inputs and outputs, for instance but not limited to, a modulator/demodulator (modem; for accessing another device, system, or network), a radio frequency (RF), wireless, or other transceiver, a telephonic interface, a bridge, a router, or other devices that function both as an input and an output.

When the classifier 10 is in operation, the processor 12 is configured to execute the software 22 stored within the memory 20, to communicate data to and from the memory 20, and to generally control operations of the classifier 10 pursuant to the software 22. The software 22 and the O/S 36, in whole or in part, but typically the latter, are read by the processor 12, perhaps buffered within the processor 12, and then executed.

When functionality of the classifier 10 is implemented in software, as is shown in FIG. 2, it should be noted that the functionality can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The classifier 10 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device.

The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The storage device 30 of the classifier 10 is optional and may be one of many different types of storage device, including a stationary storage device or portable storage device. As an example, the storage device 30 may be a magnetic tape, disk, flash memory, volatile memory, or a different storage device. In addition, the storage device may be a secure digital memory card or any other removable storage device 30. The storage device 30 may store different data therein, such as, but not limited to, data history collected regarding vehicles approaching an intersection, including vehicle speed, range (position), and acceleration (also referred to as kinematic data). In addition, the storage device 30 may store data history specific to the driver of the vehicle. This enables a driver to switch vehicles and bring his/her own data history into the new vehicle. As a result, the present system and method is capable of providing driver specific results in situations when drivers switch vehicles.

It should be noted that in accordance with the present invention, the classifier may be located in one or more different locations. As an example, as previously mentioned, the classifier may be located within a vehicle. For instance, the classifier may or may not be incorporated as a part of a larger vehicle driver assistance system. Alternatively, the classifier may be located within a controller located at an intersection communicating results of classification of vehicles and detection of violating drivers (violating vehicles). Communication of classification of vehicles and detection of violating driver results may be vehicle to vehicle or vehicle to communication infrastructure. Such a communication infrastructure may be any known communication infrastructure allowing for the transmission and receipt of data.

The previously mentioned requirement of being able to integrate the classifier into a driver assistance system while balancing violator detection accuracy with driver annoyance can be encoded in terms of signal detection theory (SDT), which provides a framework for evaluating decisions made in uncertain situations. Table I., illustrated below, shows the mapping between classifier output and SDT categories. To meet this performance constraint, the classifier maximizes the number of true positives (to correctly identify violators) while maintaining a low ratio of false positives (to minimize driver annoyance).

TABLE I

| | Classification: Compliant | Classification: Violating |
|---|---|---|
| Actual: Compliant | True Negative | False Positive |
| Actual: Violating | False Negative | True Positive |

An underlying assumption for this classification is the availability of communication or sensing infrastructure to provide the observations needed to classify the driver's behavior and enable the detection of traffic signal phase. Vehicle-to-vehicle (V2V) and vehicle-to-infrastructure (V2I) communication systems would provide exactly this functionality. Alternatively, onboard sensors could be used to make these observations, particularly when warning drivers of their own impending violations.

While several scenarios could be considered for this problem, for simplicity of understanding, the present description provides the example of one host vehicle and several target vehicles. The goal is to warn the host vehicle when any of the target vehicles is predicted not to comply with the traffic lights. To further specify the problem, the following assumptions are made.

1) The host vehicle has the right of way and is compliant. Only the target vehicles that do not have the right of way are considered in the problem; the other vehicles (i.e., with right of way) are ignored. In other words, the focus is on warning compliant drivers from the danger created by other potentially violating drivers. An implicit assumption is the existence of V2V and V2I systems to detect the traffic signal phase and to share position, speed (velocity), and acceleration information among vehicles (also referred to as kinematic data).

Figure 3:
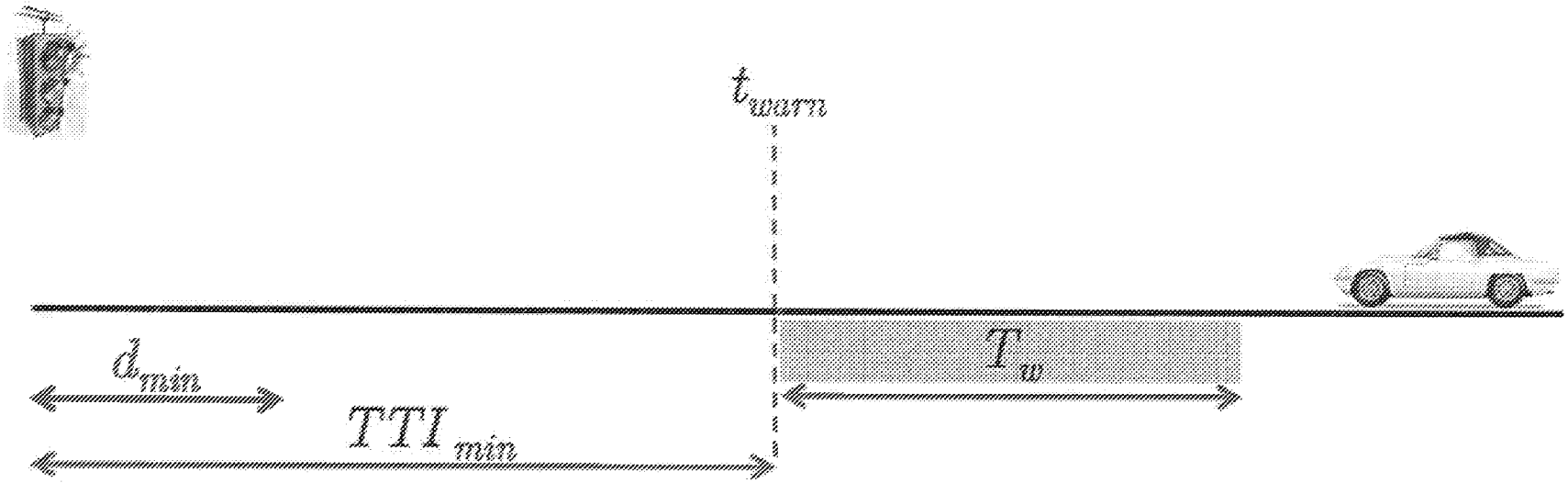
FIG. 3 is a schematic diagram illustrating different warning-related variables as used by the classifier of FIG. 2.

2) The host vehicle is warned at $t_{warn}$ only when a target vehicle is classified as violating. The schematic diagram of FIG. 3 illustrates the different warning-related variables. $t_{warn}$ corresponds to the time when a target vehicle's estimated time to arrive at the intersection, also known as TTI, reaches $TTI_{min}$ seconds, or when the distance of a target vehicle to the intersection is equal to $d_{min}$ meters, whichever condition happens first. The time and distance thresholds are chosen such that the host driver has enough time to react to the warning. A detailed analysis of the choice of $TTI_{min}$ and $d_{min}$ is presented hereinbelow when describing implementation with shared parameters.

3) The target vehicles are tracked as early as possible, but their classification as violating or compliant is based on measurements taken in the $T_w$ time window as illustrated by FIG. 3. Different values of $T_w$ are analyzed in the developed algorithms; a larger $T_w$ brings a longer measurement "memory" at the expense of an additional computation requirement. A large $T_w$ might also include irrelevant measurements when the vehicle is very far from the intersection. Finally, it is noted that a target vehicle that stops in or before the $T_w$ window is directly labeled as compliant.

Classification

Classifying human drivers as either compliant or as a violator is a complex process because of various nuances and peculiarities of human behaviors. Basic classification is traditionally performed by identifying simple relationships or trends in data that define each class. This includes using techniques such as model fitting and regression to identify classification criteria. However, by only considering simple relationships, these approaches are limited in their ability to accurately classify complex data where the classes may be defined by a variety of factors. The present invention overcomes this limitation by use of at least one of two approaches by the classifier. A first approach is use of a discriminative approach based on support vector machines, and a second approach is use of a generative approach based on Hidden Markov Models (HMMs). Either one of these approaches may be used by the classifier in accordance with the present invention to assist in classifying human drivers as either compliant or as a violator of road intersection rules, specifically, whether a human driver will stop at an intersection red light or not.

Discriminative approaches, such as Support Vector Machines (SVMs), are typically used in binary classification problems, which make them appropriate for the classification of compliant versus violating human drivers. SVMs have several useful theoretical and practical characteristics. The following highlights two of these characteristics: 1) training SVMs involves an optimization problem of a convex function, thus the optimal solution is a global solution (i.e., no local optima); 2) the upper bound on the generalization error does not depend on the dimensionality of the problem.

Classification is often also performed using generative approaches, such as HMMs, to model the underlying patterns in a set of observations and explicitly compute the probability of observing a set of outputs for a given model. HMMs are well suited to the classification of dynamic systems, such as a vehicle approaching an intersection. The states of the HMM define different behavioral modes based on observations, and the transitions between these states capture the temporal relationship between observations.

It should be noted that while the following provides algorithms for use in expressing functionality performed by the classifier, the present invention is not intended to be limited by use of only the algorithms described herein. Instead, functionality associated with such algorithms may be expressed by different algorithms or logic in general, all of which are intended to be included in the present invention.

Discriminative Approach

Use of the discriminative approach for classifying drivers, in accordance with the present invention, is described further herein. The discriminative approach, as used by the present system and method, combines SVM and Bayesian filtering, and is referred to herein as SVM-BF. In accordance with a first exemplary embodiment of the invention, the discriminative approach is provided as an algorithm. The core of the algorithm is the SVM, which is a supervised machine learning technique based on the margin-maximization principle. The present system and method combines SVM with a Bayesian filter (BF) that enables it to perform well on the driver behavior classification problem. The following introduces the architecture of the SVM-BF algorithm and provides additional theoretical and practical details about each of its components.

SVM-BF Architecture

Figure 4:
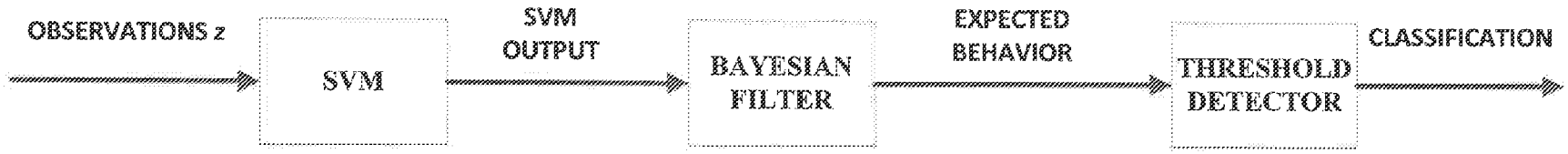
FIG. 4 is a schematic diagram illustrating architecture of the SVM-BF algorithm used by the classifier of FIG. 2.
Figure 5:
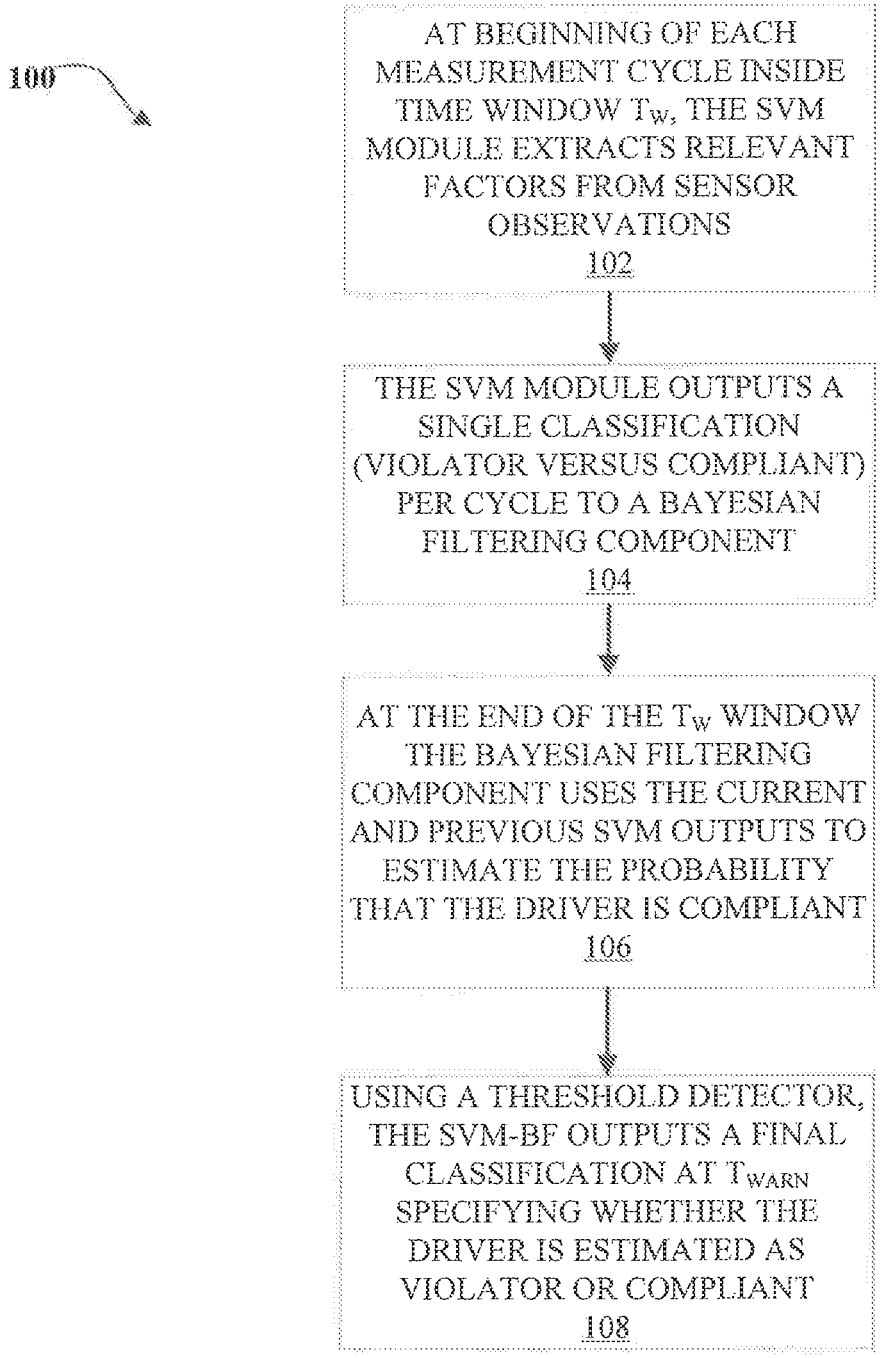
FIG. 5 is a flowchart describing the basic functions performed by the SVM-BF algorithm, in accordance with the first exemplary embodiment of the invention.

The architecture of the SVM-BF algorithm is shown by the schematic diagram of FIG. 4. In addition, the flowchart 100 of FIG. 5 describes the basic functions performed by the SVM-BF algorithm, in accordance with the first exemplary embodiment of the invention. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

As shown by block 102, at the beginning of each measurement cycle inside the $T_w$ window, the SVM module (described hereinbelow) extracts the relevant features from sensor observations. It then outputs a single classification (violator versus compliant) per cycle to the BF component (described hereinbelow) (block 104). As shown by block 106, at the end of the $T_w$ window, namely, at time $t_{warn}$, the BF component uses the current and previous SVM outputs to estimate the probability that the driver is compliant. Using a threshold detector, the SVM-BF outputs a final classification at $t_{warn}$ specifying whether the driver is estimated as violator or compliant (block 108).

In accordance with an alternative embodiment of the invention, to speed up the convergence of the BF component, a discount function is added to the SVM-BF designed to deemphasize earlier classifications in $T_w$ and therefore put more weight on the measurements of the vehicles that are closer to $t_{warn}$.

SVM Module

The following provides an introduction to SVMs and their implementation in the present SVM-BF framework. Further information regarding SVMs is provided by the publication entitled, "Support vector networks," by C. Cortes and V. Vapnik, Mach. Learn., vol. 20, no. 3, pp. 273-297, September 1995, which is incorporated herein by reference in its entirety.

Given a set of binary labeled training data $\{x_i, y_i\}$ where $i=1, \ldots, N$, $y_i \in \{+1, -1\}$, $x_i \in \Re^d$, N is the number of training vectors, and d is the size of the input vector, a new test vector z is classified into one class (y=+1) or the other (y=−1) by evaluating the following decision function:

$$D(z) = sgn\left[\sum_{i=1}^{N} \alpha_i y_i K(x_i, z) + B\right] \quad \text{(Eq. 1)}$$

$K(x_i, x_j)$, which is known as the kernel function, is the inner product between the mapped pairs of points in the feature space, and B is the bias term. α is the argmax of the following optimization problem:

$$\max_{\alpha} W(\alpha) = \sum_{i=1}^{N} \alpha_i - \frac{1}{2}\sum_{i,j=1}^{N} \alpha_i \alpha_j y_i y_j K(x_i, xj) \quad \text{(Eq. 2)}$$

subject to the constraints $$\sum_{i=1}^{N} \alpha_i y_i = 0 \alpha_i \geq 0 \quad \text{(Eq. 3)}$$

Appropriate kernel selection and feature choice are essential to obtaining satisfactory results using SVM. Based on experimenting with different kernel functions and several combinations of features, the best results for this problem were obtained using the Gaussian radial basis function and combining the following three features: 1) range to intersection; 2) speed; and 3) longitudinal acceleration.

At each measurement cycle, the output of the SVM block is a classification y=+1 (compliant) or y=−1 (violator). This output is then fed into the Bayesian filtering module, as described hereinbelow, which uses additional logic before making a final classification.

BF Module

The following describes BF module implementation in the present SVM-BF framework. The BF module views the outputs of the SVM component as samples of a random variable y∈{violator, compliant} that is controlled by a parameter θ such that $$p(y=\text{compliant}|\theta)=\theta \quad \text{(Eq. 4)}$$

The parameter θ is unknown. It represents the probability that the driver belongs to the compliant class. The role of the BF module is to compute the expected value of θ given a sequence of previous outputs from the SVM module.

To infer the value of the hidden variable, a standard Bayesian formulation is used. A beta distribution was selected prior for θ, which is a function of some hyperparameters a and b, for instance as shown by equation 5

$$\text{beta}(\theta \mid a, b) = \frac{\Gamma(a+b)}{\Gamma(a)+\Gamma(b)}\theta^{a-1}(1-\theta)^{b-1} \quad \text{(Eq. 5)}$$

where Γ(x) is the gamma function. The values of a and b have an intuitive interpretation; they represent the initial "confidence" given for each class, respectively. In other words, they reflect the number of observations corresponding for each behavior, which were accumulated in previous measurement cycles.

Given a sequence of SVM outputs $y=[y_1, \ldots, y_N]$, the posterior distribution of θ, i.e., p(θ|y), is computed by multiplying the beta distribution prior by the binomial likelihood function given by equation 6

$$\text{bin}(m \mid N, \theta) = \binom{N}{m}\theta^{m}(1-\theta)^{N-m} \quad \text{(Eq. 6)}$$

where m and l represent the number of SVM outputs corresponding to y=compliant and y=violator, respectively. The variable N is the total number of SVM classifications: N=m+l. By normalizing the resulting function, the following equation 7 is obtained.

$$p(\theta \mid y) = \frac{\Gamma(m+a+l+b)}{\Gamma(m+a)+\Gamma(l+b)}\theta^{m+a-1}(1-\theta)^{l+b-1} \quad \text{(Eq. 7)}$$

The expected value of θ given the sequence y, which is the output of the BF component, can then be expressed by equation 8.

$$E(\theta \mid y) = \int_0^1 \theta p(\theta \mid y)\, d\theta = \frac{m+a}{m+a+l+b} \quad \text{(Eq. 8)}$$

Discount Function

As previously mentioned, to speed up the convergence of the BF, a discount function is added to the SVM-BF designed to deemphasize earlier classifications in the $T_w$ window and therefore put more weight on the measurements of the vehicles that are closer to $t_{warn}$.

To improve the accuracy of the expected value computed in equation 8, earlier classifications in the $T_w$ window should be given less weight compared with later classifications. The following discount function, as illustrated by equation 9, achieves the desired purpose $$d_k = C^{N-k}, \text{ with } d_0 = C^N \quad \text{(Eq. 9)}$$

where k=1 . . . N is the index of the SVM output in the $T_w$ window, N represents the index of the last output in $T_w$, i.e., at time $t_{warn}$, and C is a constant discount factor (0<C≤1) used to discount exponentially the weight of the output at time k. It should be noted that C=1 is equivalent to no discounting. The value of C affects the performance of the SVM-BF significantly. The description of SVM-BF parameters, as provided hereinbelow, investigates different values for C in the search for the best combination of the SVM-BF parameters. The variables m and l also need to be indexed by k, where $m_k$ and $l_k$ are the binary outputs of SVM at step k, and $m_k+l_k=1$. Given these changes, equation 8 can be rewritten as $$E(\theta \mid y) = \frac{\sum_{k=1}^{N} d_k m_k + d_0 a}{\sum_{k=1}^{N} d_k m_k + d_0 a + \sum_{k=1}^{N} d_k l_k + d_0 b} \quad \text{(Eq. 10)}$$

where a and b are the same hyperparameters defined in equation 5.

Threshold Detector

Given E(θ|y), the SVM-BF algorithm outputs the final classification based on the threshold detector specified value $\tau_S$. The driver is classified as compliant if $E(\theta|y)>\tau_S$; otherwise, it is classified as violating. A large threshold value $\tau_S$ is equivalent to a more conservative algorithm (catching more violators) but at the expense of an increased number of wrong warnings (i.e., false positives). The choice of the value/parameter of $\tau_S$ is analyzed and described hereinbelow with reference to implementation of the SVM-BF algorithm.

Sliding Window

An extension to the present SVM-BF algorithm is the introduction of a sliding window over the features, which proves to be valuable in improving the performance of the SVM-BF on road traffic data. To elaborate, each feature includes the means and variances of the last K different measurements. This change replaces the individual measurements (range, velocity, and acceleration) with their means and variances computed over the window. This addition indirectly adds time dependency to the sequence of outputs of the SVM component without affecting computation times, thus improving the SVM-BF model. The choice of the value of K is analyzed and described hereinbelow with reference to implementation of the SVM-BF algorithm.

Generative Approach

Use of the generative approach for classifying drivers, in accordance with the present invention, is described further herein. This approach is based on the idea of learning generative models from a set of observations. HMMs have been used extensively to develop such models in many fields, including speech recognition, and part-of-speech tagging. The application of HMMs to isolated word detection is particularly relevant to the task of driver classification. In isolated word detection, one HMM is generated for each word in the vocabulary, and new words are tested against these models to identify the maximum likelihood model for each test word. HMMs have also been used to recognize different driver behaviors, such as turning and braking. The present system and method uses HMMs to detect patterns that characterize compliant and violating behaviors.

HMM-Based Architecture

Figure 6:
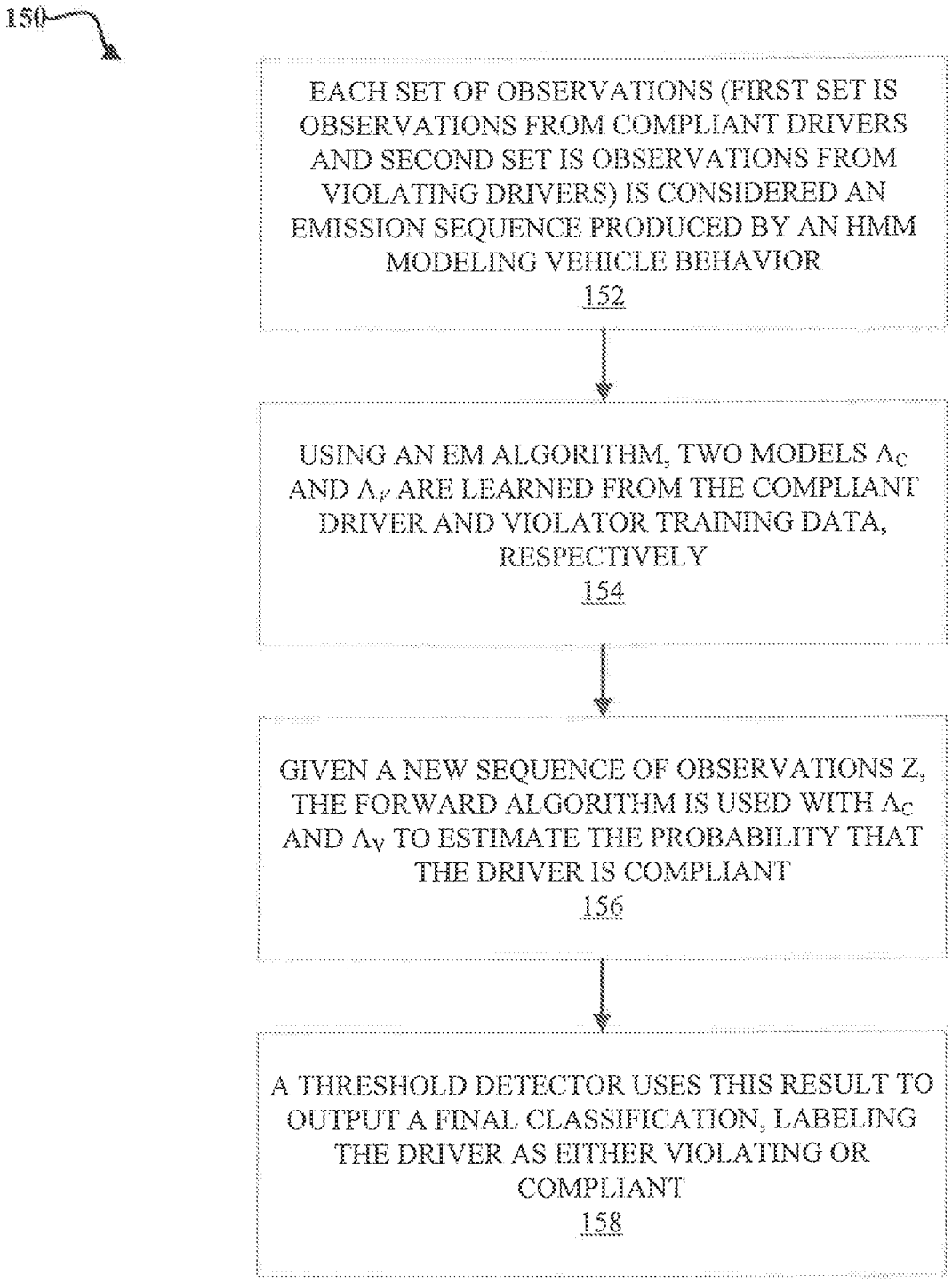
FIG. 6 is a flowchart illustrating steps taken by the HMM-based architecture used by the classifier of FIG. 2.
Figure 7:
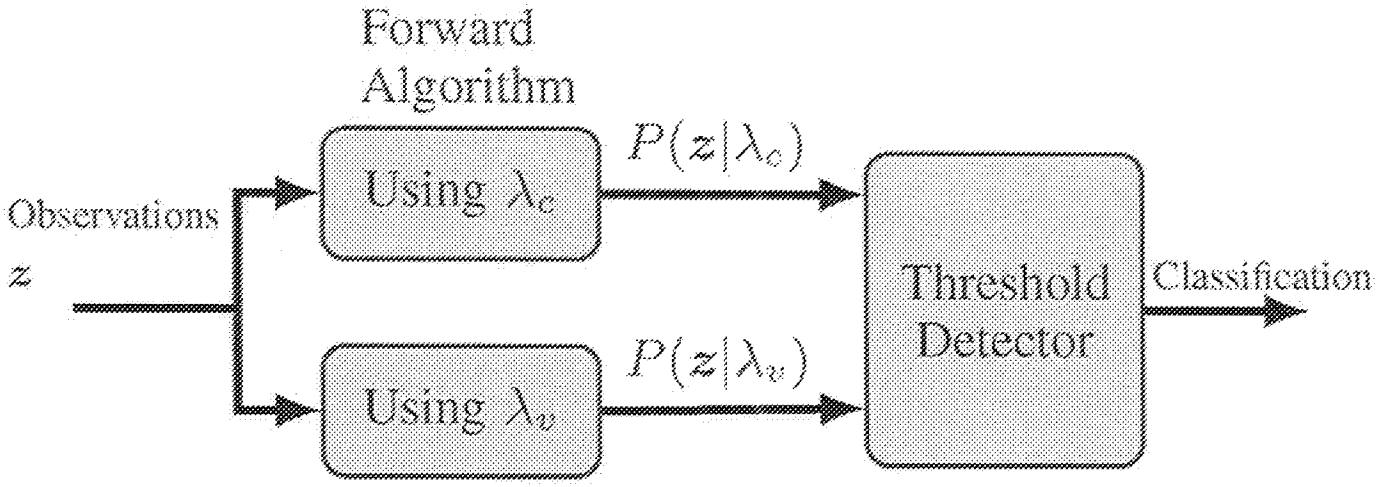
FIG. 7 is a schematic diagram summarizing the HMM-based architecture.

FIG. 6 is a flowchart 150 illustrating steps taken by the HMM-based architecture. Suppose two sets of observations are available: one known to be from compliant drivers and the other from violators. Each set of observations can be considered an emission sequence produced by an HMM modeling vehicle behavior (block 152). As shown by block 154, using an expectation-maximization (EM) algorithm (as illustrated and described hereinbelow), two models $\lambda_c$ and $\lambda_v$ are learned from the compliant driver and violator training data, respectively. Then, given a new sequence of observations z, the forward algorithm (as described hereinbelow) is used with $\lambda_c$ and $\lambda_v$ to estimate the probability that the driver is compliant (block 156). As in the SVM-BF algorithm, a threshold detector (as described hereinbelow) uses this result to output a final classification, labeling the driver as either violating or compliant (block 158). Again, this classification occurs at $t_{warn}$ based on the observations from the $T_w$ window. The schematic diagram of FIG. 7 also summarizes this architecture.

HMMs and Forward Algorithm

In order to determine how well a model fits a set of observations, the classifier may use HMMs and the forward algorithm. Further information regarding HMMs and the forward algorithm is provided by the publication entitled, "A tutorial on hidden Markov models and selected applications in speech recognition," by L. Rabiner, Proc. IEEE, vol. 77, no. 2, pp. 257-286, February 1989, which is incorporated herein by reference in its entirety.

Figure 8:
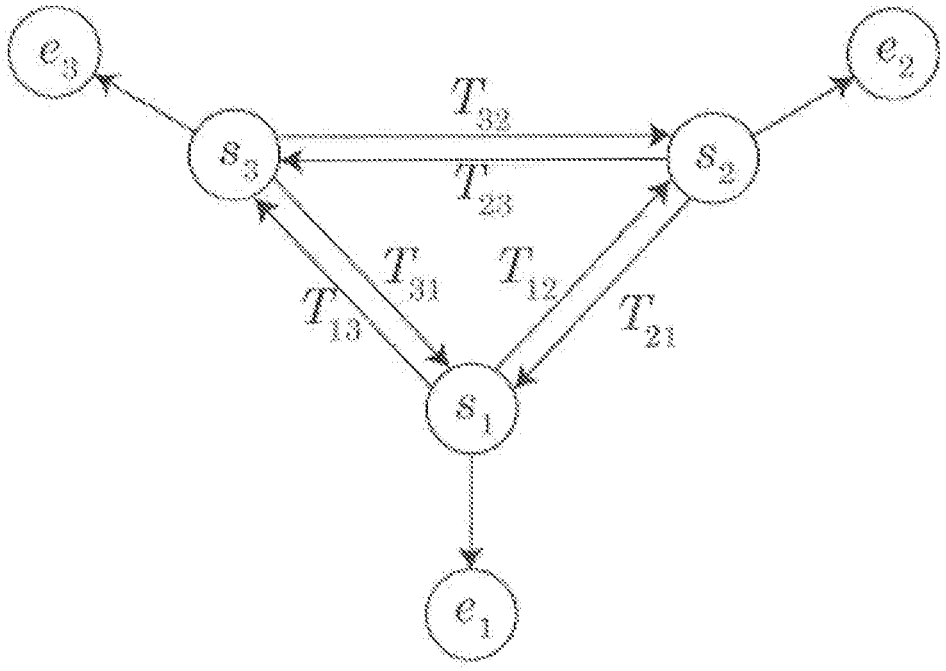
FIG. 8 is a schematic diagram illustrating an HMM $\lambda(T, t, e)$ consisting of a set of n discrete states and a set of observations at each state.

An HMM λ(T, t, e) consists of a set of n discrete states and a set of observations at each state, as exemplified by the schematic diagram of FIG. 8. At any given time k, the system being modeled will be in one of these states $q_k=s_i$, and the transition probability matrix T gives the probability of transitioning to any other state at the next time step $q_{k+1}=s_j$. Specifically, $$T_{i,j}=P(q_{k+1}=s_j|q_k=s_i \quad \text{(Eq. 11)}$$

The probability of the system starting in each state is given by the initial state distribution t, where $t_i=P(q_1=s_i)$. Due to these probabilistic transitions, the current state is typically not known. Instead, a set of observations is assumed to be available. The probability of a state $s_i$ emitting a certain observation $z_k$ is given by $e_i(z_k)$. The emission distribution for each type of observation is assumed to be Gaussian with unique mean $\mu_i$ and variance $\sigma_i^2$ at for every state This design decision ensures that each state corresponds to one specific mode of driving, which is characterized by a set of observations normally distributed around some typical values (specified by the means and variances).

A common task with HMMs is determining how well a given model λ(T, t, e) fits a sequence of observations $x=x_1, \ldots, x_K$. This can be quantified as the probability of observing x given λ, P(x|λ). The forward algorithm is an efficient method for computing this probability and is defined as follows. Let $\alpha_i(k)$ be given by $$\alpha_i(k)=P(x_1, \ldots, x_k, q_k=s_i|\lambda) \quad \text{(Eq. 12)}$$

which is the probability of observing the partial sequence $x_1, \ldots, x_k$ and having the current state $q_k$ at time k equal to $s_i$ given the model λ. Then, the forward algorithm is initialized using the initial state distribution t, i.e., $$\alpha_i(1)=t_i e_i(x_1), i=1, \ldots, n \quad \text{(Eq. 13)}$$

The probability of each subsequent partial sequence of observations for k=1, . . . ,K−1 is given by $$a_j(k+1) = \left[\sum_{i=1}^{n} a_i(k) T_{ij}\right] e_j(x_{k+1}), \quad i = 1, \ldots, n \quad \text{(Eq. 14)}$$

Upon termination at k=K, the algorithm returns the desired probability $$P(x \mid \lambda) = \sum_{i=1}^{n} a_i(K). \quad \text{(Eq. 15)}$$

EM Algorithm for HMMs

The abovementioned observations can also be used to learn an HMM that captures the behavior of the underlying system. A standard technique for doing so, i.e., the EM algorithm, is subsequently summarized herein. An illustration of the complete algorithm is detailed in work entitled "A gentle tutorial on the EM algorithm and its application to parameter estimation for Gaussian mixture and hidden Markov models," by J. Bilmes, Int. Comput. Sci. Inst., Berkeley, Calif., Tech. Rep. ICSI-TR-97-021, 1997, which is incorporated by reference herein in its entirety.

Given a set of N observation sequences (training data) $x_1, \ldots, x_N$, the EM algorithm computes the maximum likelihood estimates of the HMM parameters, as shown by the following equation.

$$\lambda^*(T, t, e) = \underset{\lambda}{\operatorname{argmax}} P(x_1, \ldots, x_N \mid \lambda(T, t, e)) \quad \text{(Eq. 16)}$$

To do so, it uses the forward algorithm, as defined earlier, as well as the backward algorithm, which is defined similar to the forward algorithm. Let $$\beta_i(k) = P(x_{k+1}, \ldots, x_K \mid q_k = s_i, \lambda) \quad \text{(Eq. 17)}$$

be the probability of observing the rest of the partial sequence of observations at time k for $k \leq K$. Then, the backward algorithm follows as $$\beta i(K) = 1 \quad \text{(Eq. 18)}$$

$$\beta_j(k) = \sum_{j=1}^{n} T_{ij} e_j(x_{k+1}) \beta_i(k+1) \quad \text{(Eq. 19)}$$

Using the terms $\alpha_i(k)$ from the forward algorithm and $\beta_i(k)$ from the backward algorithm, the probability of being in state $s_i$, at time k given the observations x is given by $$\gamma_i(k) = P(q_k = s_i \mid x, \lambda) = \frac{\alpha_i(k)\beta(k)}{\sum_{i=1}^{n} \alpha_i(k)\beta_i(k)} \quad \text{(Eq. 20)}$$

Then the probability of being in state $s_i$, at time k and state $s_j$ at time k+1 is given by $$\xi_{ij}(k) = P(q_k = s_i, q_{k+1} = s_j \mid x, \lambda) = \frac{\alpha_i(k) T_{ij} e_j(x_{k+1}) \beta_j(k+1)}{\sum_{i=1}^{n} \sum_{j=1}^{n} \alpha_i(k) T_{ij} e_j(x_{k+1}) \beta_j(k+1)} \quad \text{(Eq. 21)}$$

From these terms, the parameters of an updated HMM $\bar{\lambda}$ are computed with the following update equations:

$$\pi_i = \gamma_i(1) \quad \text{(Eq. 22)}$$

$$T_{ij} = \frac{\sum_{k=1}^{K-1} \xi_{ij}(k)}{\sum_{k=1}^{K-1} \gamma_i(k)} \quad \text{(Eq. 23)}$$

$$\mu_i = \frac{\sum_{k=1}^{K} \gamma_i(k) x_k}{\sum_{k=1}^{K} \gamma_i(k)} \quad \text{(Eq. 24)}$$

$$\sigma_i = \frac{\sum_{k=1}^{K} \gamma_i(k)(x_k - \mu_i)^2}{\sum_{k=1}^{K} \gamma_i(k)} \quad \text{(Eq. 25)}$$

These maximum-likelihood estimates reflect the relative frequencies of the state transitions and emissions in the training data.

Repeating this procedure with $\lambda$ replaced by $\bar{\lambda}$ is guaranteed to converge to a local maximum, i.e., as the number of iterations increases, $P(x_1, \ldots, x_N \mid \bar{\lambda}) - P(x_1, \ldots, x_N \mid \lambda) \rightarrow 0$. The resulting $\lambda$, is the maximum likelihood model $\lambda^*(T, t, e)$. Since the EM algorithm is only guaranteed to converge to a local maximum, several sets of random initializations can be tested to reduce the effects of local maxima on the final model parameters.

As with the choice of features in the SVM, the observations used for the HMM can have a dramatic impact on its performance. After testing several combinations of observations, the following five parameters were identified to give the best results in terms of high detection accuracy and low false positive rates: 1) range to intersection; 2) speed; 3) longitudinal acceleration; 4) TTI; and 5) RDP. In addition, the observations can be normalized to remove any bias introduced by differences in the order of magnitude of the observations.

Threshold Detector

Using the EM algorithm, two models, namely, $\lambda_c$ and $\lambda_v$, are learned from the compliant driver and violator training data, respectively. Then, given a new sequence of observations z, the forward algorithm of equation 25 is used with $\lambda_c$ and $\lambda_v$ to find the posterior probability of observing that sequence given each model $P(z \mid \lambda_c)$ and $P(z \mid \lambda_v)$. The prior over the models is assumed to be uniform $P(\lambda_c) = P(\lambda_v) = 0.5$ since nothing is known beforehand about whether the driver is compliant or violating. Then, the likelihood ratio of as illustrated by the following equation $$\frac{P(z, \lambda_c)}{P(z, \lambda_v)} = \frac{P(z \mid \lambda_c)}{P(z \mid \lambda_v)} > e^{-T_H} \quad \text{(Eq. 26)}$$

determines whether the driver is more likely to be compliant or violate the stop bar and assigns the corresponding classification. Note that this ratio is typically computed using log probabilities, which introduces the e term in the likelihood ratio of equation 26. The threshold $\tau_H$ can be selected to adjust the conservatism of the classifier and is discussed in greater detail with regard to HMM parameters, as described hereinbelow.

Since states have one emission distribution per observation, each state in the HMM represents a coupling between specific ranges of values for each observation. It is this coupling and the transitions between different coupled ranges that allow the HMM-based classifier to distinguish between compliant drivers and violators.

Data Collection and Filtering

The following provides an example of data collecting and filtering and is provided merely for exemplary purposes. The present invention is not intended to be limited by this example of data collection and filtering. Instead, this example is provided so as to provide an example of the context in which data may be acquired.

The roadside data is collected regarding many approaches of vehicles at one or more intersection. As an example, data on over 5,500,000 approaches across three intersections may be collected. For instance, data from the Peppers Ferry intersection at U.S. 460 Business and Peppers Ferry Rd in Christiansburg, Va., were used to evaluate the abovementioned algorithms, providing a total of 3,018,456 car approaches. At the Peppers Ferry intersection, a custom data acquisition system was installed to monitor real-time vehicle approaches. This system included four radar units that identified vehicles, measured vehicle speed, range, and lateral position at a rate of 20 Hz beginning approximately 150 m away from the intersection, a GPS antenna to record the current time, four video cameras to record each of the four approaches, and a phase sniffer to record the signal phase of the traffic light. These devices collected data on drivers who were unaware of the collection and testing as they moved through the intersection.

The information from these units then underwent postprocessing, including smoothing and filtering to remove noise such as erroneous radar returns. In addition, the geometric intersection description—a detailed plot of the intersection accurate to within 30 cm—was used to derive new values such as acceleration, lane id, and a unique identifier for each vehicle. Information on each of the car approaches was then uploaded onto an SQL database, which was used to obtain the data as described herein.

The data were further processed. Specifically, individual trajectories from the data collected were filtered. To maintain tractable offline runtimes for the learning phases of the algorithms, the first 300,000 trajectories out of the 3,018,456 car approaches were extracted. They were classified as compliant or violating based on whether they committed a traffic light violation. Violating behaviors included drivers that committed traffic violation at the intersection, defined as crossing over the stop bar after the presentation of the red light and continuing into the intersection for at least 3 m within 500 ms. Compliant behaviors included vehicles that stopped before the crossbar at the yellow or red light. Out of the extracted trajectories, 1,673 violating and 13,724 compliant trajectories were found and then used in the classification algorithms.

Implementation

The following highlights several decisions made in implementing the different algorithms previously mentioned. It is noted that this is provided for exemplary purposes. First is described training and testing procedures used for data validation and the rationale that motivates them. Also described is an analysis tool used to compare algorithm performance against parameter choice. Second is described parameters that are common to all the algorithms. More specifically, the values of the variables affecting the warning timing and the maximum driver annoyance levels are described. Third is described the choice of parameters that are specific to the SVM-BF and HMM algorithms, respectively.

Training/Testing Approaches

Using trajectories selected from a database storing collected vehicle data, the algorithms are tested in pseudo real time, i.e., by running them on the trajectories of the database as if the observations of the target vehicle were arriving in real time. The observations from each trajectory were downsampled from 20 to 10 Hz to reduce the computational load. The training and testing were performed using two different approaches: 1) basic generalization test as mentioned hereinbelow, and 2) m-fold cross validation, also as mentioned hereinbelow. Both approaches aim at evaluating the generalization property of the algorithms.

To evaluate the results of these tests, the receiver operation characteristic (ROC) curve is used to display the true positive and false positive rates of each set of algorithm parameters. The curve is generated by varying a parameter of interest (or set of parameters), which is referred to as the beta parameter in the SDT terminology. Each point on the ROC curve then corresponds to a different value of the beta parameter. The choice of beta for each algorithm is subsequently detailed in its respective section.

1) Basic Generalization Test:

The first approach is a straightforward test of generalization. This consists of training the algorithms on a randomly selected subset that is some small fraction p of the data and testing on the remaining 1−p. This approach demonstrates the generalization property (or lack thereof) of the algorithms. This property is essential for any warning algorithm to perform successfully when deployed on driver assistance systems, particularly given the number of vehicles encountered in everyday driving. The value of p is chosen to be 0.2. The total number of trajectories used for this approach is 10000 compliant and 1000 violating. In other words, 2000 compliant and 200 violating trajectories are used in the training phase, whereas the testing phase consists of 8000 compliant and 800 violating trajectories.

2) m-Fold Cross Validation:

The second approach uses the standard m-fold cross-validation technique for testing generalization. This involves randomly dividing the training set into m disjoints and equally sized parts. The classification algorithm is trained m times while leaving out, each time, a different set for validation. The mean over the m trials estimates the performance of the algorithm in terms of its ability to classify any given new trajectory. The advantage of m-fold cross validation is that, by cycling through the m parts, all the available training data can be used while retaining the ability to test on a disjoint set of test data. A total of 5000 compliant and 1000 violating trajectories are used in the m-fold approach with m=4. First, each algorithm is run once on these data with the same ratio of training and testing data, producing a classifier with fixed parameters. This classifier is then tested using the m-fold cross-validation approach.

Shared Parameters

1) Minimum Time Threshold $TTI_{min}$: For each trajectory, as shown in FIG. 3, the final output of the algorithms is given at time $t_{warn}$, which is computed as shown by equation 26

$$t_{warn}=\min(TTI_{min}, t(d_{min})). \quad \text{(Eq. 26)}$$

In other words, $t_{warn}$ corresponds to the time when the estimated remaining time for the target vehicle to arrive to the intersection is $TTI_{min}$ seconds, or when the distance to the intersection is equal to $d_{min}$ meters, whichever happens first.

The choice of $TTI_{min}$ is important. It represents the amount of time the host vehicle is given to react after being warned that a violating target vehicle is approaching its intersection. Choosing one single mean value for $TTI_{min}$ provides little information about the performance of the warning algorithms for response times away from the mean. Instead, the choice of $TTI_{min}$ is based on the cumulative human response time distribution presented in the article entitled "A method for evaluating collision avoidance systems using naturalistic driving data," by S. McLaughlin, J. Hankey, and T. Dingus, Accident Anal. Prev., vol. 40, no. 1, pp. 8-16, January 2008, which is incorporated by reference herein in its entirety. This distribution answers the following question: given a specific driver response time, what is the percentage of population that is able to react to a potential collision? The larger $TTI_{min}$, the bigger the percentage of population to react on time to the warning. But a larger $TTI_{min}$ is expected to lead to a worse performance of the warning algorithms because the final classification would be given earlier and after fewer measurements. To address this problem, the different algorithms were developed and evaluated for three different values of $TTI_{min}$ summarized in Table II, as provided hereinbelow. They are 1.0, 1.6, and 2.0 s, corresponding to 45%, 80%, and 90% of the population, respectively.

TABLE II

CUMMULATIVE POPULATION PERCENTILE VERSUS DRIVER RESPONSE TIME

| RESPONSE TIME(S) | POPULATION PERCENTILE |
|---|---|
| 1.0 | 45% |
| 1.6 | 80% |
| 2.0 | 90% |

Therefore. the engineer deciding which algorithm to implement has a clearer understanding of the tradeoffs for each choice. Note that the host vehicle is assumed to be at rest or moving with a negligible speed in this analysis. This is typically the case at $t_{warn}$, the time where it is warned of the target vehicle possible violation.

2) Minimum Distance Threshold $d_{min}$: The $d_{min}$ distance plays the role of a safety net. In most intersection approaches, the $TTI_{min}$ condition happens first. But for some cases where the target vehicle approaches the intersection with a low speed, the $TTI_{min}$ condition is met too close to the intersection. The $d_{min}$ condition ensures that such cases are captured, and warning (if needed) is given with enough time for the driver to react. For $TTI_{min}$ of 1.6 s, $d_{min}$ is chosen to be 10 m. This is equivalent to situations where vehicles cross the $d_{min}$ mark with speeds lower than 6.25 m/s or 22.5 km/h, consistent with the low-speed assumption. For $TTI_{min}$ of 1.0 and 2.0 s, $d_{min}$ is scaled to 6.25 and 12.5 m, respectively. These values are summarized in Table III, s provided hereinbelow. Note that in the case of a warning, the driver will have a period of time larger than $TTI_{min}$ to react, ensuring that the percentage of drivers responding on time to the warning is consistent with Table II numbers.

TABLE III

MINIMUM $TTI_{MIN}$ AND MINIMUM DISTANCE $d_{MIN}$ PAIRS

| $TTI_{min}$ (s) | $d_{min}$(m) |
|---|---|
| 1.0 | 6.25 |
| 1.6 | 10.0 |
| 2.0 | 12.5 |

3) Maximum FP Rate: Warning algorithms must take into consideration driver tolerance levels. i.e., they should try to ensure that the rate of false alarms is below a certain "annoyance" level that is acceptable to most drivers. For exemplary purposes, the maximum false positive rate is chosen to be 5%, in accordance with automotive industry recommendations. Therefore, the developed algorithms are designed and tuned under the constraint of keeping false positive rates below 5%, while trying to maximize true positive rates.

SVM-BF Parameters

Figure 9:
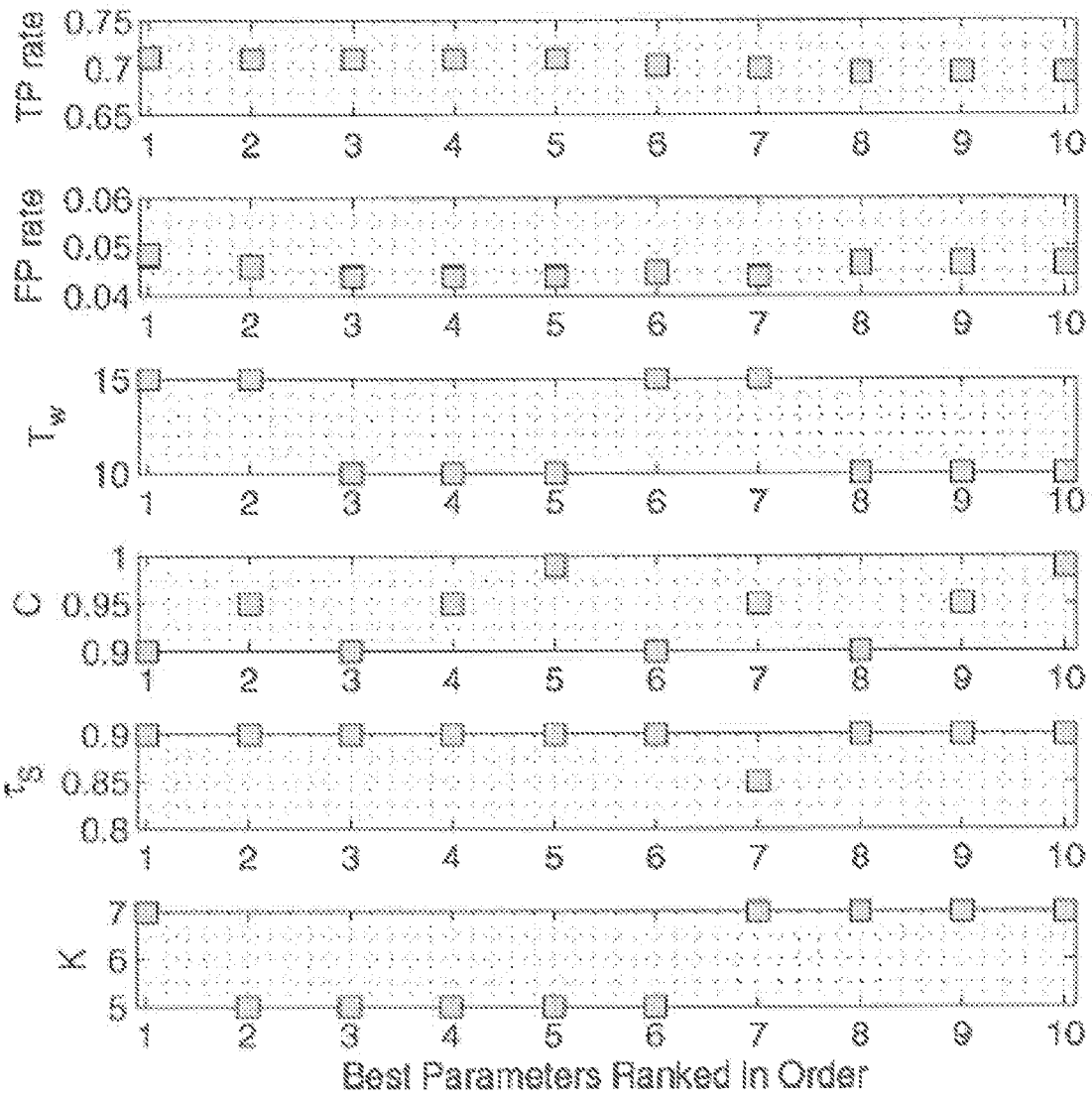
FIG. 9 is a schematic diagram illustrating ten combinations of key parameters for the SVM-BR classifier that produced the highest rates of true positives while maintaining a false positive rate below 5% for one basic generalization test.

There are four key parameters for the SVM-BF classifier: 1) the T, window size; 2) the discount factor C; 3) the decision threshold $\tau_S$; and 4) the sliding window size K. The threshold variable is selected as the beta parameter as it was introduced specifically to tune the performance of the algorithm. Models with $T_w$ varying from 5 to 15 observations were considered, whereas C varied from 0.5 to 1.0 and K ranged from three to ten measurements. All combinations of these parameters were tested, and the schematic diagram of FIG. 9 shows the ten combinations that produced the highest rates of true positives while maintaining a false positive rate below 5% for one basic generalization test. The results of this test were obtained using the best combination of parameters in FIG. 9: $T_w$=15, K=7,C=0.9, and $\tau_S$=0.9. The hyperparameters a and b in equation 5 are set both to 0.5, specifying no bias toward either behavior. These values could be changed to reflect a bias toward one driving behavior if the classifier is given prior knowledge of the target driving history.

HMM Parameters

Figure 10:
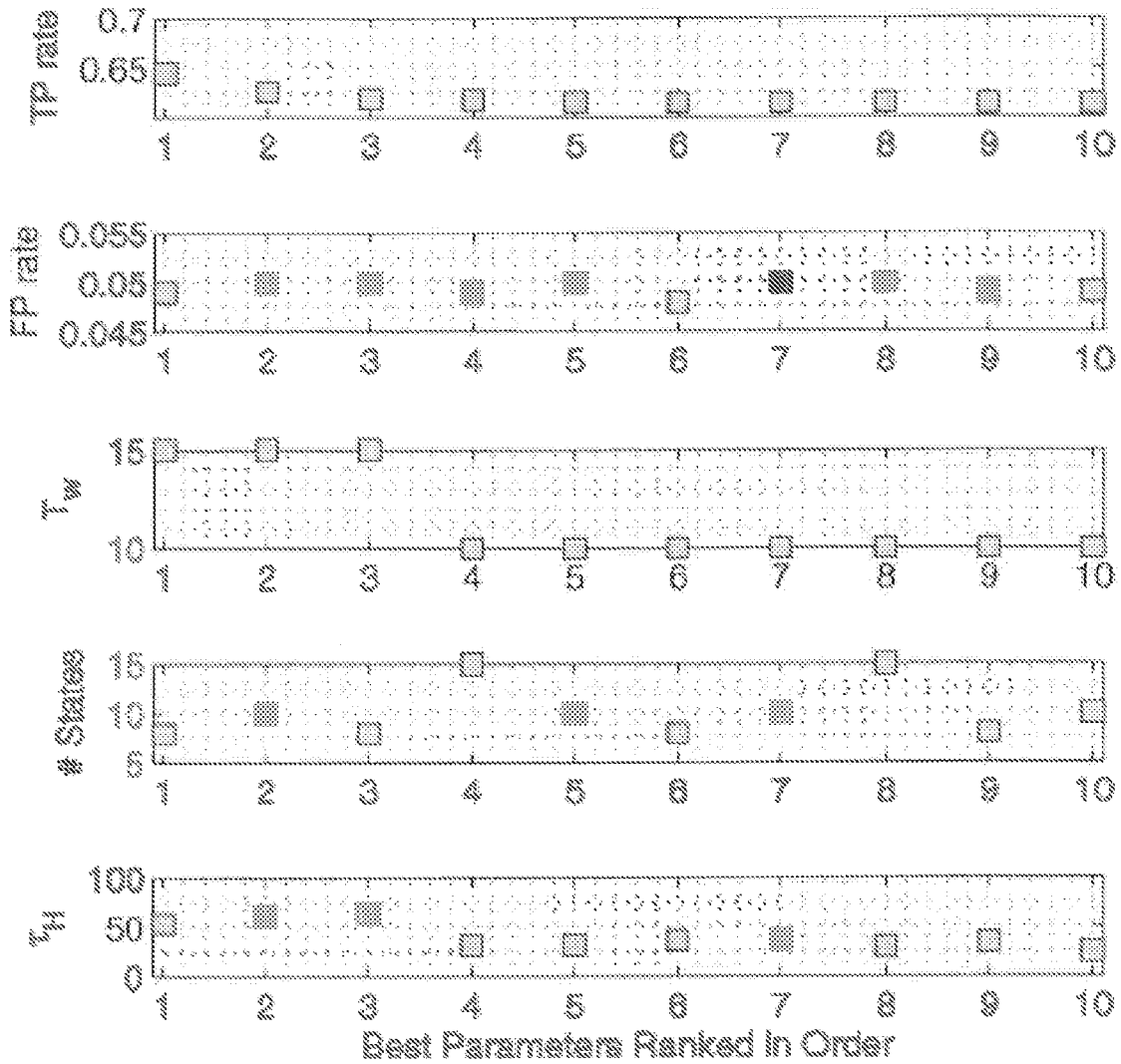
FIG. 10 is a schematic diagram illustrating ten combinations of key parameters for the HMM-based classifier that produced the highest rates of true positives while maintaining a false positive rate below 5% for one basic generalization test.

There are three key parameters for the HMM-based classifier: 1) the number of states in the HMM; 2) the $T_w$ window size; and 3) the decision threshold $T_H$. As in the previous methods, the threshold is selected as the beta parameter. The number of states determines how many different modes the HMMs can capture, and as a result, the range of behaviors that can be classified accurately. However, increasing the number of states also increases the complexity of the model and the risk of overfitting the training data. Models with between 6 and 15 states were considered, whereas $T_w$ was varied from 10 to 20 observations. All combinations of these parameters were tested, and the schematic diagram of FIG. 10 shows the ten combinations that produced the highest rates of true positives while maintaining a false positive rate below 5% for one basic generalization test. The results for this test were obtained using the best combination of parameters in FIG. 10: $T_w$=15, eight states, and $\tau_H$=54.4. Recall that $\tau_H$ defines a threshold on the likelihood ratio and is distinct from $\tau_S$, which is a threshold on the probability of being classified as compliant. Monte Carlo testing was used to learn multiple models for each set of parameters to reduce the effects of local minima on the algorithm.

In accordance with an alternative embodiment of the invention, the present system and method is capable of maintaining classification of a driver even when the driver changes vehicles. Specifically, as previously mentioned, the storage device may store data history specific to the driver of a vehicle. This enables a driver to switch vehicles and bring his/her own data history into the new vehicle. As a result, the present system and method is capable of providing driver specific results in situations when drivers switch vehicles.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A warning system configured to predict whether a vehicle will come to a stop at an intersection before a first time, comprising:

at least one sensor configured to measure vehicle data of the vehicle, wherein the vehicle data comprises:

a speed of the vehicle, an acceleration of the vehicle and a distance from the vehicle to the intersection; and a classifier comprising at least one processor coupled to the at least one sensor configured to:

receive vehicle data measured by the at least one sensor at a plurality of times during a time window, wherein the vehicle data comprises a plurality of measurements of each of:

the speed of the vehicle;

the acceleration of the vehicle; and the distance from the vehicle to the intersection;

generate a prediction of whether the vehicle will or will not stop at the intersection before the first time based on the vehicle data measured during the time window; and at a second time, the second time being before the first time and approximately equal to a time at which the time window ends so that the time window extends from the second time to the first time, provide an indication that the vehicle will not stop at the intersection before the first time based upon the prediction; and an output device for providing a user of the warning system with the production of whether a vehicle will not come to a stop at the intersection before the first time, wherein generating the prediction comprises using a classification model, the classification model configured to indicate whether the vehicle will or will not stop at the intersection before the first time based on a plurality of input parameters, wherein the plurality of input parameters comprises a speed, an acceleration and a distance to an intersection, and wherein generating comprises determining the means and variances of the last K measurements of the speed of the vehicle, acceleration of the vehicle, and distance from the vehicle to the intersection.

2. The system of claim 1, wherein the classifier is a component of a vehicle based system.

3. The system of claim 1, wherein the classifier is implemented on a portable computing device.

4. The system of claim 1, wherein the classifier is a component of an infrastructure based system.

5. The system of claim 1, wherein the at least one sensor is onboard the vehicle.

6. A classifier for predicting whether a vehicle will come to a stop at an intersection before a first time, wherein the classifier comprises:

a memory and a processor configured by the memory to perform the steps of:

generating a prediction of whether the vehicle will or will not stop at the intersection before the first time based on a plurality of vehicle data measurements measured during a time window; and at a second time, the second time being before the first time and approximately equal to a time at which the time window ends so that the time window extends from the second time to the first time, providing an indication that the vehicle will not stop at the intersection before the first time based upon the prediction, wherein generating the prediction comprises using a classification model, the classification model configured to indicate whether the vehicle will or will not stop at the intersection before the first time based on a plurality of input parameters, wherein the plurality of input parameters are selected from the group consisting of speed, acceleration, and distance to the intersection, and wherein generating comprises determining the means and variances of the last K measurements of the speed of the vehicle, acceleration of the vehicle, and distance from the vehicle to the intersection.

7. The classifier of claim 6, wherein the classifier is a component of a vehicle based system.

8. The system of claim 6, wherein the classifier is implemented on a portable computing device.

9. The classifier of claim 6, wherein the classifier is a component of an infrastructure based system.

10. The classifier of claim 6, wherein the plurality of input parameters are produced by at least one onboard sensor.

11. The classifier of claim 6, wherein the plurality of vehicle data measurements measured during the time window comprise approximately 5 to 15 observations sampled at 10 to 20 Hz.

12. The classifier of claim 6, wherein the plurality of vehicle data measurements measured during the time window comprise approximately 10 to 20 observations sampled at 10 to 20 Hz.

13. A method of producing a classification model with a classifier for predicting whether a vehicle will stop at an intersection before a signal at the intersection indicating a stopping condition is presented, comprising:

obtaining vehicle data for a plurality of vehicles, the vehicle data for at least a first vehicle comprising:

an indication of whether the first vehicle stopped at the intersection before a first signal indicating a stopping condition was presented at the intersection; and a plurality of values measured at a plurality of times during a time window prior to the first signal indicating the stopping condition, the plurality of values comprising a plurality of each of:

a speed of the first vehicle;

an acceleration of the first vehicle: and a distance from the first vehicle to the intersection:

training a classification algorithm to, based on a plurality of inputs, generate a probability that a vehicle will stop at the intersection before a signal at the intersection indicating a stopping condition is presented, wherein the plurality of inputs comprises:

the vehicle data for the plurality of vehicles, wherein the vehicle data comprises means and variances of the last K measurements of the speed of a vehicle, acceleration of the vehicle, and distance of the vehicle to the intersection; and the duration of the time window;

combining the trained classification algorithm with a probabilistic classifier to produce a classification model, wherein the probabilistic classifier determines whether a vehicle will or will not stop at the intersection before a signal at the intersection indicating a stopping condition is presented based on a respective probability for the vehicle produced by the classification algorithm; and outputting whether the vehicle will stop at an intersection.

14. The method of claim 13, wherein the trained classification algorithm comprises a discriminative approach.

15. The method of claim 14, wherein the plurality of values measured at a plurality of times during a time window comprise approximately 5 to 15 observations sampled at 10 to 20 Hz.

16. The method of claim 13, wherein the trained classification algorithm comprises a generative approach.

17. The method of claim 16, wherein the plurality of values measured at a plurality of times during a time window comprise approximately 10 to 20 observations sampled at 10 to 20 Hz.

* * * * *